US010724813B1

(12) United States Patent
Stanley

(10) Patent No.: US 10,724,813 B1
(45) Date of Patent: Jul. 28, 2020

(54) STEALTH FIREARM SAFETY AND TRIGGER LOCK SYSTEM

(71) Applicant: J. D. Stanley, Powell Butte, OR (US)

(72) Inventor: J. D. Stanley, Powell Butte, OR (US)

( * ) Notice: Subject to any disclaimer, the term of this patent is extended or adjusted under 35 U.S.C. 154(b) by 0 days.

(21) Appl. No.: 16/673,605

(22) Filed: Nov. 4, 2019

(51) Int. Cl.
*F41A 17/46* (2006.01)

(52) U.S. Cl.
CPC ..... *F41A 17/46* (2013.01)

(58) Field of Classification Search
CPC ..... F41A 17/46
See application file for complete search history.

(56) References Cited

U.S. PATENT DOCUMENTS 6,141,896 A * 11/2000 Oberst ..... F41A 17/02 42/70.06
6,173,518 B1 * 1/2001 Oberst ..... F41A 17/02 42/70.06
6,256,917 B1 * 7/2001 Findlay ..... F41A 17/02 42/70.06
6,629,379 B1 * 10/2003 Doiron ..... F41A 17/02 42/70.06
2017/0299304 A1 * 10/2017 Otte, Jr. ..... F41A 17/46
2020/0033088 A1 * 1/2020 Nguyen ..... F41A 17/46

FOREIGN PATENT DOCUMENTS

FR 2851332 A1 * 8/2004 ..... F41A 17/02
WO WO-2018134447 A1 * 7/2018 ..... F41A 17/46

* cited by examiner

*Primary Examiner* — Joshua T Semick
(74) *Attorney, Agent, or Firm* — Donn K. Harms

(57) ABSTRACT

A secondary trigger safety is provided in a trigger mechanism which employs first rotating member which is rotatable between a safety on position preventing firing and a safety off position enabling trigger firing. The secondary trigger safety is coaxially positioned within a formed axial passage in the first rotating member. To position the trigger in the safety off position to allow firing, both the first rotating member and the second rotating member must be turned to respective positions aligning a passage in the first rotating member with a recess in the second rotating member.

10 Claims, 5 Drawing Sheets

STEALTH FIREARM SAFETY AND TRIGGER LOCK SYSTEM

FIELD OF THE INVENTION

The disclosed device concerns firearms. More particularly, it relates to a device and method for securing firearms against unintentional and unauthorized use through the provision of a stealth coaxial trigger safety and trigger lock system.

BACKGROUND OF THE INVENTION

Firearms in the modern era conventionally employ a bullet or shell which is positioned within the firearm and has both propellent and the projectile in a single unit. Once operatively positioned within a firearm, a trigger mechanism either in a single action or double action, causes the actuation of a hammer or firing pin which strikes the bullet or shell to cause it to discharge and propel the projectile from the barrel of the firearm toward an intended target.

Because of the ease of activating the trigger of many modern firearms, conventionally they are also equipped with a trigger safety mechanism or switch. Such trigger safety switches generally have two primary positions. A first such position is in the safety-on mode, wherein the trigger of the firearm is prevented from actuation which thereby prevents the accidental or unintentional actuation of the trigger and firing of the firearm. A second such position of the safety switch is the safety-off position, wherein the trigger on the firearm is operable by a user to fire the weapon. Some automatic weapons may have a third position configuring the weapon for automatic sequential firing of the weapon. However, the safety on such weapons will still have a safety-on position to prevent firing of the weapon.

While such a safety switch mechanism is in widespread use in firearms and works well to prevent the owner or authorized user of the weapon, it does not prevent unauthorized users from taking and firing the weapon since a simple rotation of the safety will place the firearm in the firing position. As a consequence, for example, children gaining access to a firearm frequently are aware of how to move a safety switch to the safety-off position so that the weapon may be fired. Additionally, where the firearm is stolen or taken from the owner by an individual familiar with trigger safety mechanisms, it may be used against the owner.

As a consequence, while conventional trigger safety switches employed with modern firearms work well in many instances, they do not prevent the unauthorized use of the weapon by older children and others coming into possession of it. The consequences of such can be significant harm and loss of life to others encountering the individual who has such unauthorized possession of the firearm.

The device and method herein provide for a secondary safety switch which is employable on firearms having a rotating member engaged to the safety which is switchable between a firing and non firing position. The secondary safety switch, however, is in a stealth or hidden position running coaxial to the original safety switch and requires a user key to actuate it between positions. It thereby prevents unauthorized actuation of the trigger of the weapon to which it is engaged.

The forgoing examples concerning firearms employing safety switches, and issues regarding such, are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The device herein provides a solution to the shortcomings of conventional firearm trigger safety switches which are employed to prevent the accidental discharge of a firearm. As noted, such conventional trigger safety switches are user employable and conventionally rotate between a safety-on configuration and a safety-off position. In the safety-on position, a portion of a rotating member is rotated to a position where it blocks the actuation of the trigger mechanism to fire the weapon. By trigger mechanism is meant an assembly of engaged components which are activated by a trigger to cause ammunition within the firearm to discharge when the trigger is pulled or activated by the user.

In one such configuration disclosed herein as an example but in no way limiting, moving the safety to an on position will cause a rotating member to block the pathway followed by the trigger bar during a pulling of the trigger of a trigger mechanism. Thus when the trigger is pulled to actuate movement of a trigger bar operatively engaged with the trigger a distance along that pathway, the device blocks the pathway thereby preventing the trigger from actuating the trigger mechanism and firing the weapon. When the rotating member is moved to the safety-off position, such as by pushing a lever engaged to the rotating member, it rotates the member to position a passage in the rotating member in an alignment with the trigger pathway which must be followed by the trigger bar or similar component. This allows the trigger, when pulled, to actuate the trigger mechanism to fire the weapon. Such lever actuated safety switches which use a rotating member to block movement of a trigger mechanism component, and having a passage in the rotating member to allow movement of the blocked component of the mechanism, are used in many firearms, for example the AR15 type long gun.

The device herein configures such a conventional lever rotated safety switch, to have two different rotating members running coaxially. Either of the rotating members will prevent movement of the blocked trigger mechanism such as a trigger bar, to prevent firing of the weapon. The device herein may be provided as a retrofit component allowing the removal and replacement of an existing rotating firearm safety switch, or it may be provided for operative rotating engagement with an existing firearm safety switch which employs a rotating member to block or allow trigger mechanism movement for trigger actuation.

A particularly preferred mode of the device, is the provision of the device in assembled or user engageable components, which will replace the conventional rotating safety switch of a firearm. In such a mode, the device will be configured to engage within and operate in and with the intended trigger mechanism. In this fashion the user may remove the original safety with a single rotating member and replace it with the device herein having two different coaxially positioned rotating members that are both independently positionable to either prevent or to allow firing of the weapon.

In another mode, parts may be provided to allow the factory or original single rotating member trigger safety to be machined and modified. Once so modified to allow coaxial first and second rotating members, a provided second rotating member will be engaged to an axial passage machined into the original rotating member of the original safety switch.

In all modes of the device, it features a first rotating member having a first position preventing operative movement of a trigger component, such as a trigger bar engaged to a trigger, to fire the trigger mechanism of the firearm. In all preferred modes the device also has a second position allowing operative movement of the blocked trigger mechanism component of the original trigger mechanism, thereby allowing actuation of the trigger mechanism to fire the weapon.

Also included, in all modes of the device, is a secondary rotating member, which is coaxially rotationally engaged within an axial passage formed into the first rotating member. This secondary rotating member operates independently from the first rotating member and also has a first position preventing operative movement of the trigger mechanism and a second position allowing operative movement thereof and an actuation of the trigger mechanism to fire the weapon.

By trigger component as used herein, is meant the member or arm, lever, cam, or other component of a trigger mechanism of a firearm, that is blocked from movement by the rotating member of the safety on the firearm, and thereby blocks actuation of the trigger mechanism to fire the weapon. Such may be a trigger bar, member, lever, or other component which is connected directly to the finger-activated trigger or may be another component of the trigger mechanism, which the OEM or factory safety switch blocks when that safety switch is rotated to the safety-on position.

Additionally preferred, in all modes of the device herein, is configuration of the actuator of the secondary member to only rotate with the user employment of a key which is shaped or adapted to engage a formed recess in the face of the secondary member. Without this key, the secondary member will not rotate. Thus, while the user may employ a lever engaged to the first rotating member to move it to the second position with the intent to allow the movement-blocked component to be able to fire the weapon, movement of this first rotating member will not affect the positioning of the secondary rotating member. If the secondary rotating member is in the first position preventing operative movement of the trigger mechanism which would normally be blocked by the first rotating member, then the weapon will not discharge even if the first rotating member has been positioned to the second position with the intent to place it in the safety-off position. Thus, the device functions as both a trigger safety and a also as a trigger lock, since only a unique key having a tip adapted to engage with a recess on the facing end of the secondary member, will rotate it.

Also preferred in all modes of the device, is forming the device with the secondary rotating member in a stealth configuration where it either does not appear as an operable trigger safety component, or it is hidden behind a cover allowing the key therethrough. This cover will block viewing of the engagement point for the key for the secondary rotating member. This provides further safety to the device.

With respect to the above description, before explaining at least one preferred embodiment of the herein disclosed firearm safety switch and trigger lock and method therefor, it is to be understood that the invention is not limited in its application to the details of construction and to the arrangement of the components in the following description or illustrated in the drawings. The invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for the design and employment of other stealth secondary safety switches and trigger locks for firearms, and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. The term "substantially" when employed herein, means plus or minus twenty percent unless otherwise designated in range.

It is an object of the present invention to provide a stealth or substantially hidden secondary safety switch for a firearm trigger mechanism.

It is a further object of this invention to provide such a secondary safety switch which by being substantially hidden from view and by employing a unique key for actuation, will function as a trigger lock for firearms on which it is engaged.

These and other objects, features, and advantages of the presently disclosed firearm safety switch and trigger lock, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed trigger safety switch and method of formation and/or employment thereof. It is intended that the embodiments and figures disclosed herein are to be considered illustrative of the invention herein, rather than limiting in any fashion.

DETAILED DESCRIPTION OF THE INVENTION

Figure 1:
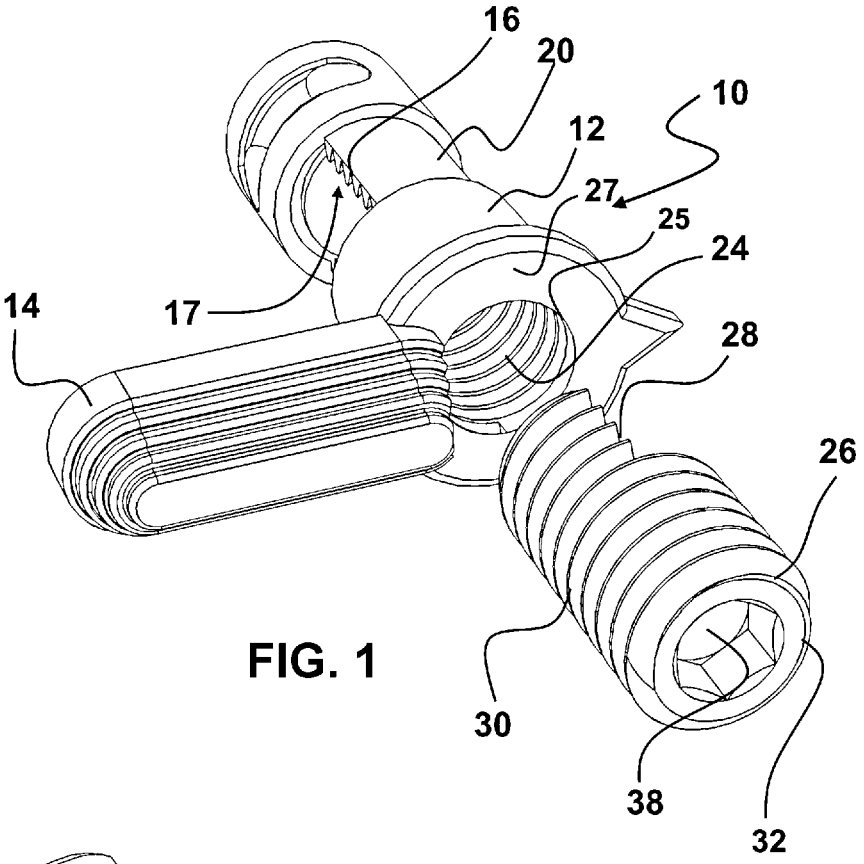
FIG. 1 depicts an exploded view of the components of the trigger safety and locking device herein.

In this description, the directional prepositions of up, upwardly, down, downwardly, front, back, top, upper, bottom, lower, left, right and other such terms refer to the device as it is oriented and appears in the drawings and are used for convenience only and such are not intended to be limiting or to imply that the device has to be used or positioned in any particular orientation.

Now referring to drawings in FIGS. 1-10, wherein similar components are identified by like reference numerals, there is seen in FIG. 1, an exploded view of the components of the a preferred mode of the trigger safety and locking device 10 herein.

As shown, the device 10 in all modes employs a first rotating member 12 which may be provided by the OEM factory installed trigger safety which is constructed with such a first rotating member 12, or which may be provide by the device 10 herein in a retrofit mode, to replace the factory installed safety having a solid core rotating member. In all modes, the device 10 herein is mounted on a firearm having a safety switch, which is actuated by a rotating member such as the first rotating member 12. This first rotating member 12 which is rotatable by a lever 14 or the like, between a first position such as in FIG. 3, where the trigger safety is off and the firearm will fire, to a second position, such as in FIG. 4, wherein the trigger safety is rotated to an on position, and thereby prevents actuation of the trigger mechanism to fire the weapon.

Figure 2:
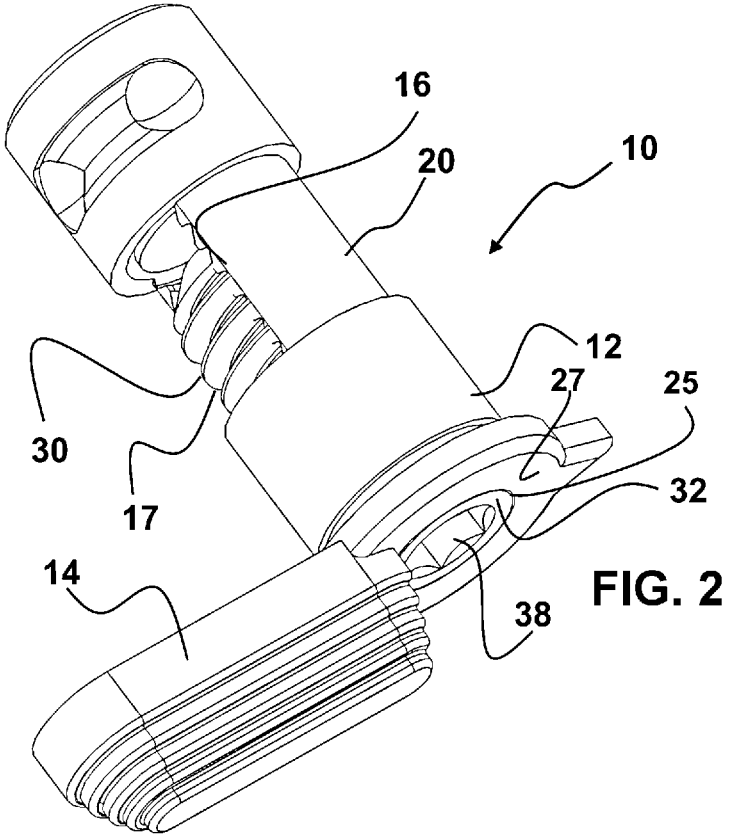
FIG. 2 shows a side perspective view of the device showing the rotatable components being coaxial to each other, but with the device herein, being separately actuated from the primary trigger safety mechanism.

As shown in FIGS. 1-2, the device 10 employs the first rotating member 12 which is operatively engaged with a firearm trigger mechanism. By operatively engaged is meant that the first rotating member 12 is rotationally engaged with the firearm, and it allows the trigger mechanism of the firearm to function to fire the firearm when it is rotated to a first position, and it blocks a component of the trigger mechanism from a required movement along a pathway 17 thereof, to fire the weapon upon pulling a trigger, when the first rotating member 12 is turned to a second position, thereby preventing firing of the firearm.

Figure 3:
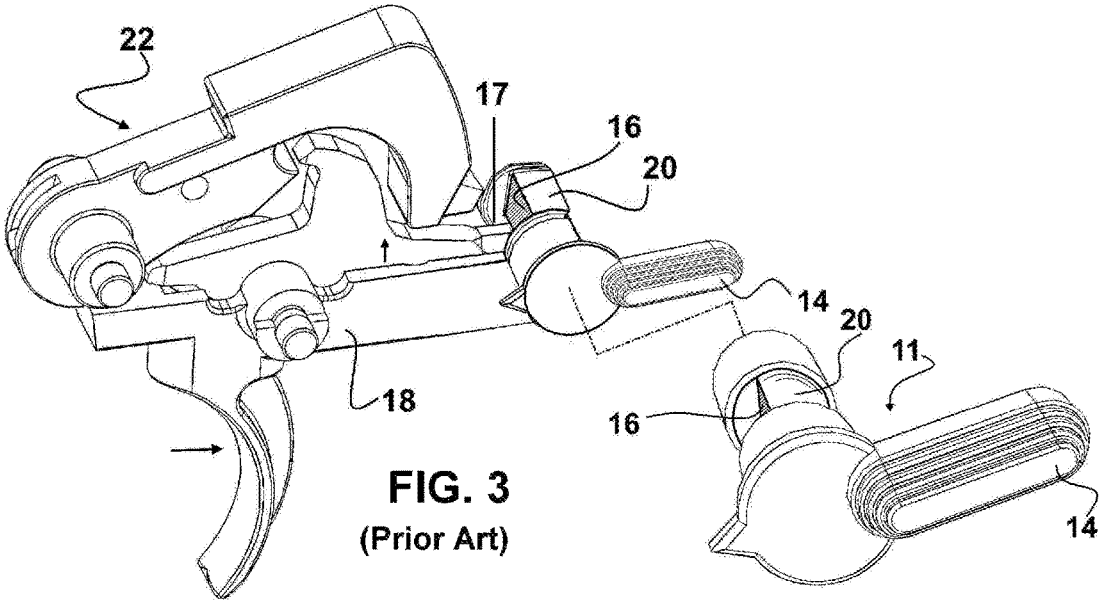
FIG. 3 (Prior Art)
FIG. 3 is a prior art depiction showing a conventional trigger safety employing a rotating member, which is rotated to a safety-off position wherein a passage formed in the rotating member allows the trigger to be actuated to fire the weapon.

The first rotating member 12 is, thus, rotatable at least between the first position allowing firing and a second position preventing it. Such rotation may be accomplished by a finger engageable actuator, herein referred to as a lever 14. As shown in FIG. 1 and FIG. 3, when the first rotating member 12, is placed in the first position or safety-off position, to deactivate the safety switch, a passage 16 formed into and across a section of the exterior surface 20 of the first rotating member 12, aligns with a pathway 17 followed during a firearm firing by a safety-restrainable trigger component 18, such as a trigger arm, allowing it to pass through the passage 16. Thus, in this first position, the safety-restrainable trigger component 18, can operatively move along the pathway 17 running through passage 16, and to actuate a firing pin or the like, to fire the ammunition in the firearm.

Rotation of the first rotating member 12 to the second, or safety-on position, prevents movement of the trigger component 18 along this pathway 17 which is followed during weapon firing to complete the actuation of the trigger mechanism to fire the weapon. Such a rotation of the first rotatable member 12 will position an exterior surface 20 thereof, directly in the pathway 17 followed by the trigger component 18, and prevent movement thereof past the exterior surface 20, thereby deactivating the trigger mechanism 22 to complete a firing sequence to fire the firearm. Such is shown, for example, in the prior art of FIG. 4, which shows this rotatable safety in the safety-on or second position, wherein the trigger component 18 such as the trigger arm, is prevented from following the pathway required to fire the firearm, by positioning the first rotatable member to the position where the exterior surface 20 thereof, blocks it.

By safety restrainable trigger component 18, or trigger component 18, is meant herein, any lever, arm, member, cam, or other trigger component, for which a first rotating member 12 of the trigger safety employed, blocks the trigger component 18 from movement a distance along a pathway 17 of travel which is required to fully actuate the trigger mechanism, to fire the weapon. Thus, when prevented from traveling the distance along a defined pathway 17, required to fully actuate the components of the trigger mechanism, a surface of a first rotatable member 12, the trigger mechanism is prevented from full actuation, and the weapon will not fire.

For example, but in no way limiting, such a trigger mechanism having an arm which must complete movement along a defined pathway 17 to fire the weapon, is conventionally employed on conventional firearms such as the AR-10 and AR-15 originally manufactured by ARMALITE and COLT, and the COLT M-4 and M-16, and similar automatic and semi-automatic rifles thereto by other manufacturers. As such, the device 10 herein is configured and meant for use with trigger mechanisms of the above referenced firearms. Further the device 10 herein is also employable with other firearms which require a trigger component to complete a movement for a distance along a pathway 17 for firing, where the device 10 herein may be positioned coaxially with a first rotating member used as the safety.

The device 10 herein, for ease of use and encouraging faster widespread use to prevent firearm accidents, can be provided in a manner making it easy to install, through the removal of the factory-provided first rotating member 12, and inserting the device 10 of FIG. 1-2 or 6-10, as a complete replacement for the factory installed first rotating member 12.

As shown, an axial passage 24 extends toward a second end of the first rotating member 12 from an opening 25 formed in an endwall 27 at a first end thereof. This axial passage 24 is formed along the center axis of the first rotating member 12 and is configured for a rotational positioning of a second rotating member 26 coaxial to the axial passage 24, and operatively positioned therein. A recess 28 running from side to side across a section of the second rotating member 26, is formed into the exterior surface 30 of this coaxially positioned second rotating member 26.

With the device 10 assembled as in FIG. 2, 7, 9, or 10, herein, the second rotating member 26 is coaxially positioned in the first rotating member 12, and independently rotatable within the axial passage 24. When the second rotating member 26 is rotated within the axial passage 24, to align the recess 28 therein with the passage 16 of the first rotating member 12, the pathway 17 followed for the distance by the restrainable trigger component 18 to fire the weapon is no longer blocked, and the firearm will fire.

However, as shown in FIG. 2, even if the first rotating member 12 is rotated to the first or safety off position aligning the passage 16 therein with the pathway 17 which must be followed by the safety restrainable trigger component 18, if the recess 28 formed across the second rotating member 26, is not aligned with the passage 16, the firearm will not fire. This is because a section of the exterior surface 30 running across the second rotating member 26, will be positioned within the passage 16 and will block the pathway 17. Thus, a user must position the safety switch using an actuator or lever 14 to the first or safety-off position, and the user must also rotate and position the second rotating member 26 to a respective first position to align the recess 28 running there across, with the passage 16. Without positioning both the first rotating member 12 and the second rotating member 26 to respective first positions, where both the passage 16 and the recess 28 are aligned, the firearm will still not fire.

The second rotating member 26 is positioned coaxially with the first rotating member 12. Preferably, only a face portion 32 at the first end of the second rotating member 26, is viewable in a position where the face portion 32 is recessed into and rotating within the opening 25 where the face portion 32 substantially aligned with or more preferably sunken into the opening 25 a distance placing the face portion within the opening 25 and below the surface of the endwall 27. This even or preferably sunken position makes the face portion 32 appear as a screw or fastener holding the first rotating member 12 in place, rather than a secondary safety.

It, thus, functions as a stealth safety switch or gun lock, as users unfamiliar with its presence will not discern it is present nor will they ascertain they must rotate it. If the slot 38 in the face portion 32 is formed to be tool engageable such as with a screwdriver or allen wrench, it will only be rotatable between the first and second position thereof, by engagement of the tool with the slot 38.

More preferably, when provided with a slot 38 formed in the face portion 32, which may only be rotated by a tool such as a key 34 having a unique engagement end 36 which is shaped to cooperatively engage within the slot 38, the user will be unable to rotate the second rotating member 26 to align the recess 28 with the passage 16, to place the firearm in a firing mode, even if they discern its presence. Such configurations of the engagement end 36 to a custom shape is available for example, as the KEY REX headless screw system available from Bryce Security Fastener in Gilbert, Ariz.

Figure 4:
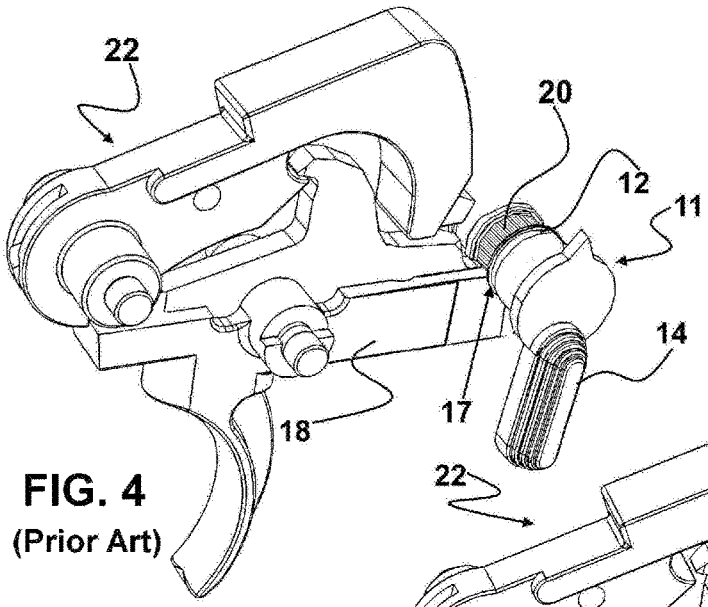
FIG. 4 (Prior Art)
FIG. 4 depicts a prior art trigger safety as in FIG. 3, where the member is rotated to a safety-on position, wherein it blocks movement of a trigger mechanism component, which actuates the trigger mechanism to fire a bullet and prevents firing of the weapon.

As noted, FIGS. 3-4 depict exemplars of prior art, where a firearm safety switch 11 is rotatable between a first of safety-on position of FIG. 4, where the passage 16 is not aligned with the pathway 17 followed by the trigger component 18 restrained from movement by the safety switch 11. When rotated to the safety-off position as in FIG. 3, the first rotating member 12 is turned to align the passage 16 formed into and across a section of the exterior surface 20 of the rotating member 12, with the pathway 17 which the trigger component 18 must follow for a distance through and past the first rotating member 12, to cause the firearm to fire. As noted above, such rotating firearm safety switches 11 are used in a number of firearms to prevent firing. As noted, the device 10 herein can be provided as a full replacement for the first rotating member 12, or in a method, an axial passage 24 may be machined into an existing first rotating member 12, and the second rotating member 26 can be rotationally engaged therein.

Figure 5:
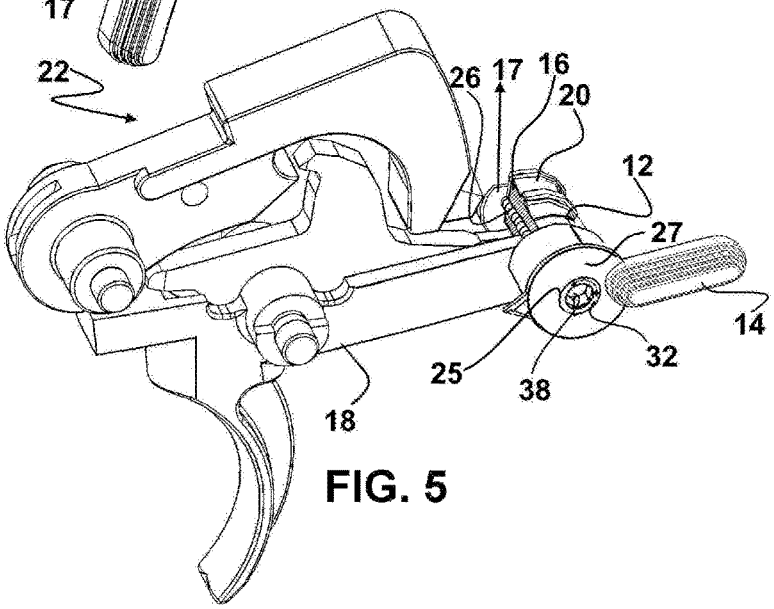
FIG. 5 shows the trigger safety device herein, such as in FIGS. 6-10, operatively coaxially engaged with a conventionally rotated member of a trigger safety wherein the conventional trigger safety is rotated to the safety-off position, as in FIG. 1, and the stealth trigger safety or trigger lock herein is still positioned to prevent trigger actuation.

In FIG. 5 is depicted, the device 10 herein, operatively positioned to form a stealth safety or trigger lock, for the firearm trigger mechanism 22 of a conventional firearm using a first rotating member 12 where it has been rotated such as with the lever 14, to position the passage 16, formed into the first rotating member 12, and align it with the travel pathway 17 for a trigger component 18. While conventionally such a positioning allows the trigger mechanism 18 to complete the travel of the trigger component 18 along the pathway 17 to fire the firearm, with the device 10 herein, the pathway 17 is still blocked by the exterior surface 30 of the second rotating member 26. This is because the second rotating member 26 has not been rotated by engaging the engagement end 36 of a key 34 with the slot 38 in the face portion 32 of the second rotating member 26, to place the recess 28 therein, in an alignment with the passage 16 of the first rotating member 12.

Figure 6:
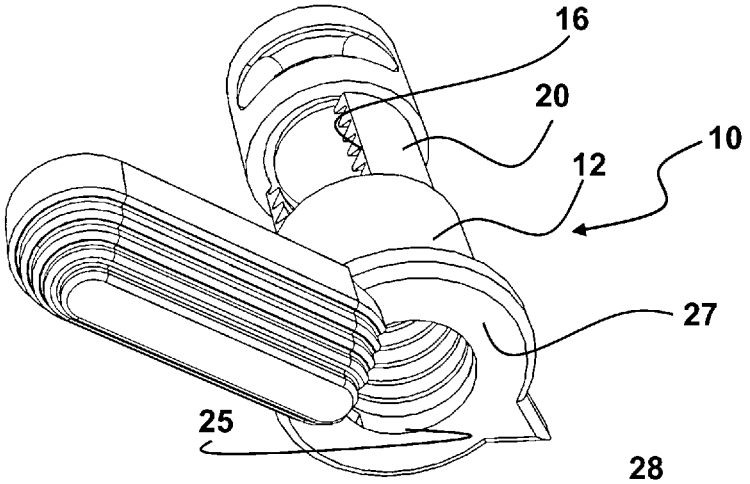
FIG. 6 shows a mode of the device herein, in an exploded view, showing the key-actuated stealth trigger safety removed from a rotational engagement coaxially positioned within an axial passage of the rotating member of the primary safety switch.

Shown in FIG. 6 is an exploded view of the device 10, showing the key-actuated second rotating member 25, removed from a rotational engagement coaxially-positioned within the axial passage 24 of the first rotating member 12 of the primary safety switch. As shown, if the second rotating member 26 is located within the axial passage 24 in the same position as shown in the exploded view in FIG. 6, the recess 28 extending across the second rotating member 25, will align with the passage 16 and allow the firearm to fire.

Figure 7:
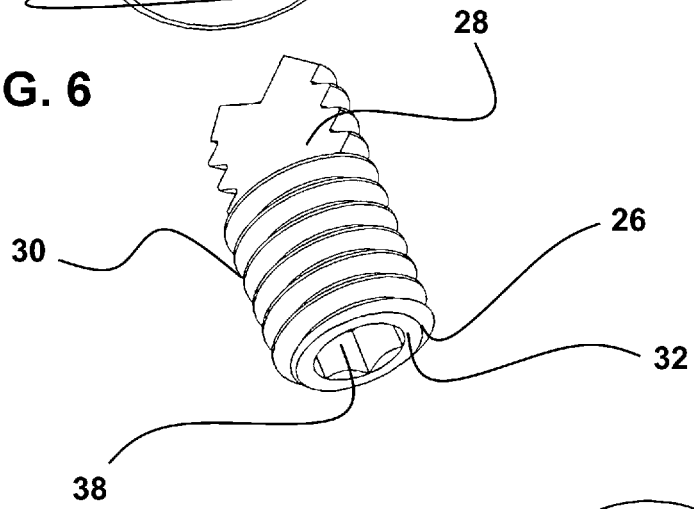
FIG. 7 depicts the device herein assembled with the key actuated trigger safety herein, rotationally engaged within an axial passage within the rotating member of the primary trigger safety, where the key actuated trigger safety is positioned to prevent trigger actuation.
Figure 7:
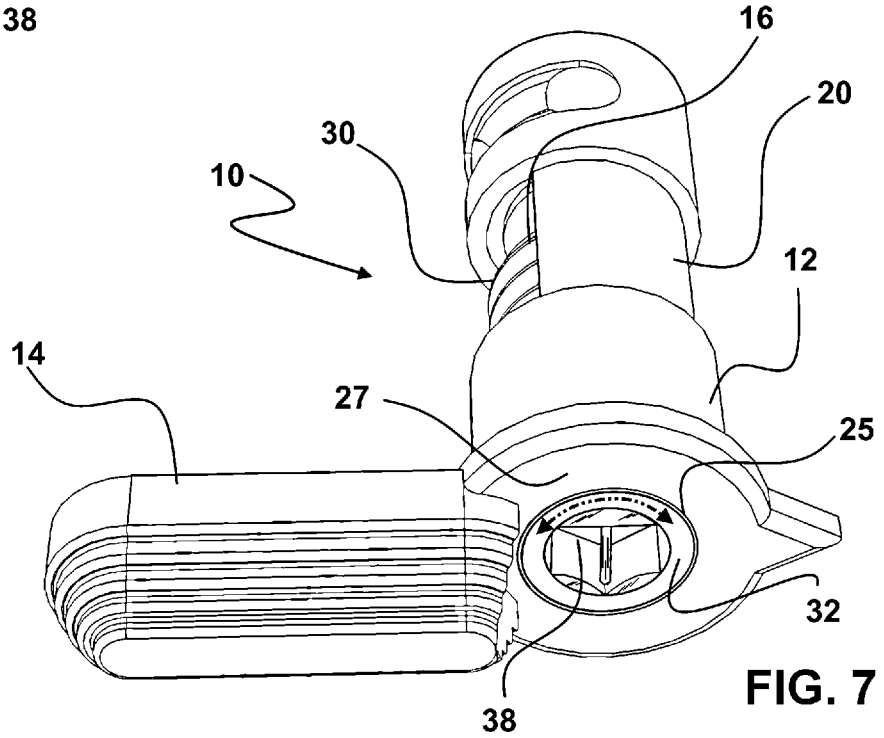

The reverse of FIG. 6 is shown in FIG. 7 which shows the device 10 assembled with the key-actuated second rotating member 26, rotationally engaged within an axial passage 24 within the first rotating member 12 of the primary trigger safety. As depicted, the recess 28 is not aligned with the passage 16 and will prevent the firearm from firing by blocking the pathway 17 noted above.

Figure 8:
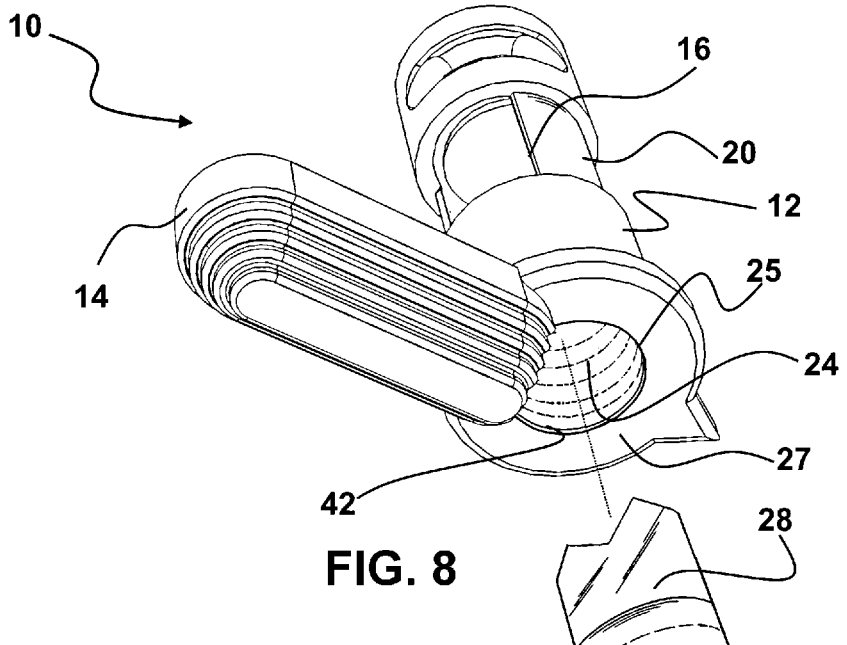
FIG. 8 shows the trigger safety device herein in an exploded view, in another mode similar to that of FIGS. 6-7 wherein the key-actuated member of the stealth safety switch is rotationally engageable within the axial passage and held in such position by a fastener.

In FIG. 8 is depicted the trigger safety device 10 herein in an exploded view, in another mode similar to that of FIGS.

6-7. In this mode, rather than threads on the exterior of the second rotating member 26 cooperatively engaging mating threads on the surface of the axial passage 24, a smooth bore axial passage 24 engages the exterior surface 30 of the second rotating member 26, and a restrainer 40 such as a clip engages a slot 42 in the axial passage 24 to hold the second rotating member 26 engaged therein.

Figure 9:
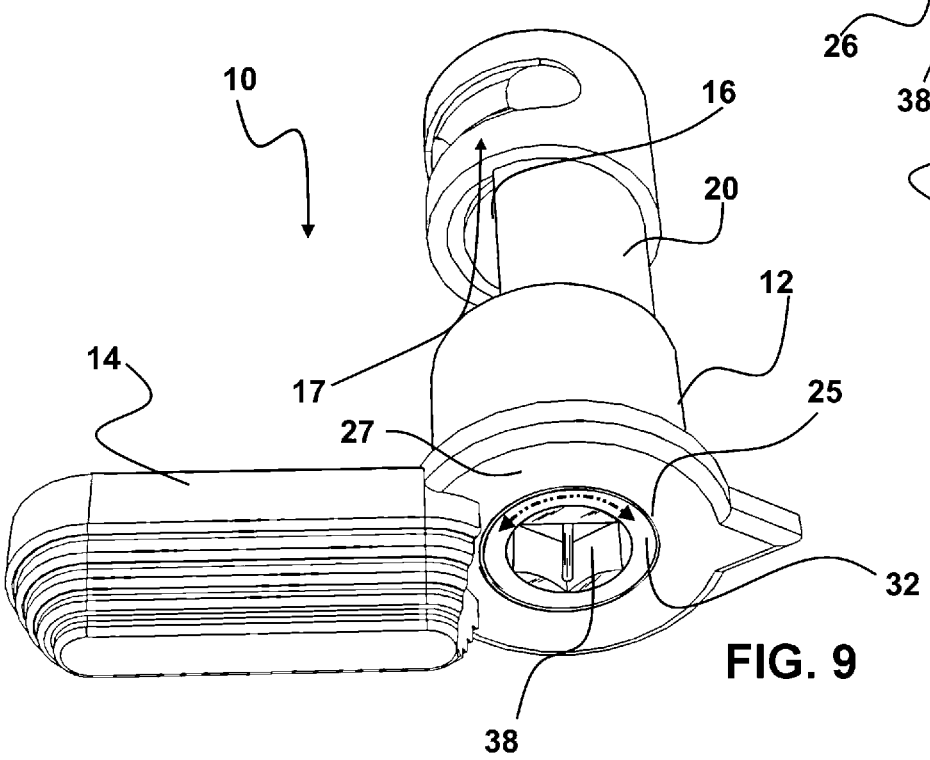
FIG. 9 shows the device in the mode of FIG. 8, assembled and showing the stealth or secondary safety switch rotated to the safety-off position wherein the trigger will fire the weapon.

In FIG. 9 is shown the device 10 in the mode of FIG. 8 or FIG. 6 for example, fully assembled. As shown, the stealth or secondary safety switch provided by the second rotating member 26, is rotated to a secondary safety-off position with the recess 28 aligning with the passage 16 in the first rotating member. This completes positioning the firearm to the safety-off position, where actuation of the trigger will fire the weapon.

Figure 10:
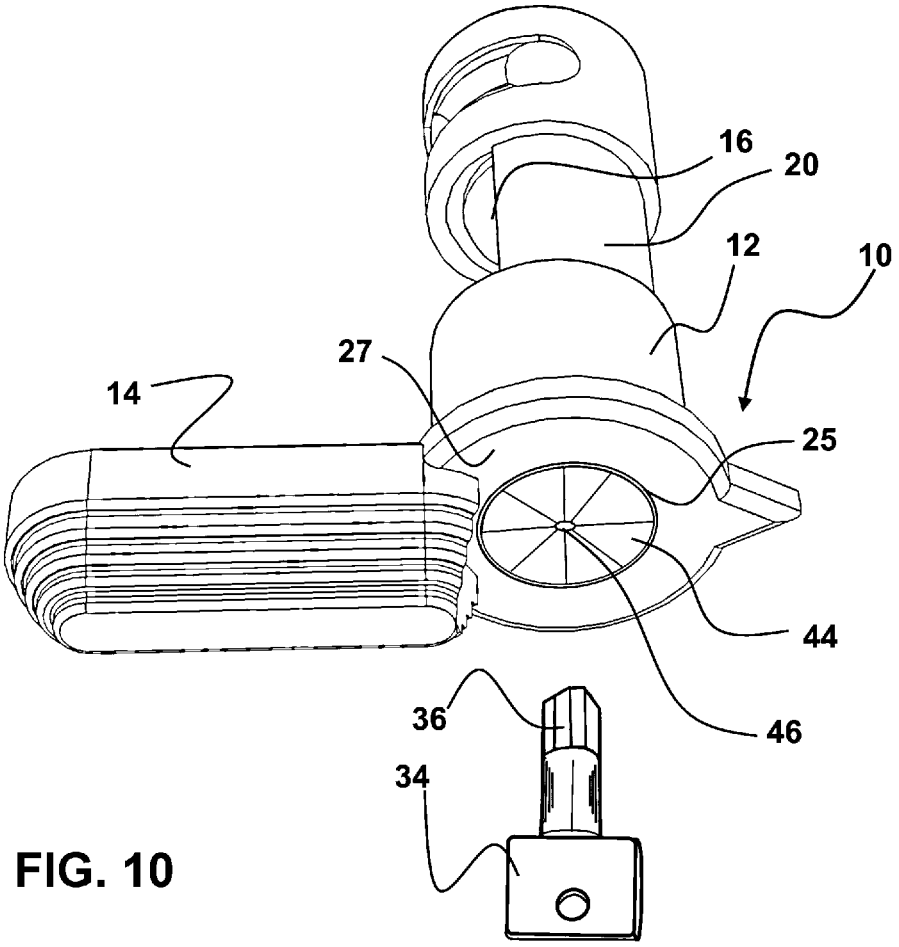
FIG. 10 shows a mode of the device herein which includes a flexible cover positioned to hide the underlying coaxially engaged key actuated safety switch and showing an example of the customized key employed herewith.

In FIG. 10 is shown another preferred mode of the device 10 which includes a flexible cover 44 which engages with the face portion 32 of the second rotating member 26, and hides the underlying key-engageable slot 38 formed into the face portion 32. An access opening 46 is provided for a user having the key 34, to engage the engagement end 36 thereof into the complimentary shaped slot 38 in the face portion 32, to rotate the second rotating member 26 between the aligned and non-aligned positions of the recess 28 therein with the passage 16 of the first rotating member 12. This access opening 46 may be smaller than the diameter of the engagement end 36 of the key 34, if the cover 44 is formed of elastic or polymeric material.

It should be noted that any of the different depicted and described configurations and components of the trigger safety and locking system herein, can be employed with any other configuration or component shown and described as part of the device herein. Additionally, while the present invention has been described herein with reference to particular embodiments thereof and/or steps in the method of production or use, a latitude of modifications, various changes and substitutions are intended in the foregoing disclosure, and it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

What is claimed is:

1. A trigger safety comprising:

a first rotating member configured for operative engagement with a firearm trigger mechanism;

an axial passage extending into said first rotating member from an opening in an endwall thereof at a first end of said first rotating member;

said first rotating member having an exterior surface running circumferentially therearound;

a passage formed into said exterior surface;

said first rotating member rotatable between a first position and a second position;

said passage configured to align with a pathway followed by a trigger component of said trigger mechanism, with said first rotating member positioned in said first position;

said exterior surface of said first rotating member blocking said pathway with said first rotating member in said second position;

a second rotating member extending between a face end and a second end thereof;

said second rotating member in a rotational engagement coaxially within said axial passage with said face end thereof positioned at said first end of said first rotating member;

said second rotating member rotatable between a first position and a second position thereof; and said second rotating member having a recess therein, said recess configured to align with said passage of said first rotating member only with said first rotating member positioned in said first position thereon, and with said second rotating member moved to said first position thereof, whereby said firearm trigger mechanism will only actuate fully to fire said firearm with both said first rotating member and said second rotating member moved to their respective first positions.

2. The trigger safety of claim 1, additionally comprising:

said face end of said second rotating member being positioned within said opening of said axial passage;

a slot formed into said face end; and said second rotating member only moveable between said first position thereof and said second position thereof, by engagement of a tool with said slot and a subsequent rotation of said tool.

3. The trigger safety of claim 1, additionally comprising:

said face end of said second rotating member being positioned within said opening of said axial passage;

a slot formed into said face end; and said slot being configured for engagement only with an engagement end of a key having a shape complimentary to a shape of said slot, wherein said second rotating member only moveable between said first position thereof and said second position thereof, by positioning said engagement end of a key into said slot, and rotation of said key.

4. The trigger safety of claim 2, additionally comprising:

said face end of said second rotating member being recessed into said opening a distance below said endwall of said first rotating member.

5. The trigger safety of claim 3, additionally comprising:

said face end of said second rotating member being recessed into said opening a distance below said endwall of said first rotating member.

6. The trigger safety of claim 2, additionally comprising:

a cover positioned within said opening adjacent said face end of said second rotating member, said cover having an access opening therein; and said access opening defining a path therethrough for passage of said tool for said engagement of said tool within said slot.

7. The trigger safety of claim 3, additionally comprising:

a cover positioned within said opening adjacent said face end of said second rotating member, said cover having an access opening therein; and said access opening defining a path for passage of said engagement end of said key therethrough for said engagement of said tool with said slot.

8. The trigger safety of claim 4, additionally comprising:

a cover positioned within said opening adjacent said face end of said second rotating member, said cover having an access opening therein; and said access opening defining a path therethrough for passage of said tool for said engagement of said tool within said slot.

9. The trigger safety of claim 5, additionally comprising:

a cover positioned within said opening adjacent said face end of said second rotating member, said cover having an access opening therein; and said access opening defining a path for passage of said engagement end of said key therethrough for said engagement of said tool with said slot.

10. A method for forming the device of claim 1 on an existing firearm having a trigger mechanism, comprising the steps of:

forming said opening and said axial passage axially into said first rotating member;

forming said second rotating member extending between said face end and said second end thereof and with said recess configured to align with said passage of said first rotating member; and positioning said second rotating member to a rotating engagement within said axial passage.

* * * * *